United States Patent [19]

Earhart et al.

[11] 4,065,740

[45] Dec. 27, 1977

[54] ELECTRICAL COIL ASSEMBLY

[75] Inventors: John E. Earhart; Frank D. Lachenmaier; John E. McConnell, all of Kokomo, Ind.

[73] Assignee: General Motors Corporation, Detroit, Mich.

[21] Appl. No.: 781,674

[22] Filed: Mar. 28, 1977

[51] Int. Cl.[2] ..... H01F 21/06; H01F 27/30

[52] U.S. Cl. ..... 336/136; 29/602 R; 336/192; 336/198; 336/205

[58] Field of Search ..... 336/90, 96, 136, 192, 336/198, 208, 205, 130; 323/90; 29/602

[56] References Cited

U.S. PATENT DOCUMENTS

| | | | |
|---|---|---|---|
| 1,832,466 | 11/1931 | Means | 336/192 X |
| 3,590,329 | 6/1971 | Krepps, Jr. | 336/192 X |
| 3,649,939 | 3/1972 | Hildebrandt | 336/136 X |
| 3,764,947 | 10/1973 | Mazzochi et al. | 336/192 X |

*Primary Examiner*—Thomas J. Kozma
*Attorney, Agent, or Firm*—Warren D. Hill

[57] ABSTRACT

A coil suitable for use as a radio component, for example, an FM trimmer coil, is formed of a self-supporting wire coil enclosed in a housing comprising two halves molded of insulated material and ultrasonically welded together to captivate the coil, ribs on the housing interior extend between turns of the coil in contact therewith to securely contain the coil turns and prevent axial movement thereof. Optionally, a threaded tuning slug is adjustably located within the coil supported by the inner ends of the ribs at a fixed spacing from the coil. Integral coil terminals extend through the housing and a window in the side of the housing allows an additional terminal to be welded to a coil turn intermediate the ends of the coil.

6 Claims, 8 Drawing Figures

ELECTRICAL COIL ASSEMBLY

This invention relates to electrical coil assembly and particularly to coil assemblies incapsulated for dimensional stability.

It is necessary to provide inductive radio components which are electrically stable. The chief cause of instability has been temperature changes which cause corresponding dimensional and electrical changes in the component. In particular, it is desirable to provide a helical coil which is substantially uneffected by temperature, especially in the axial dimension. It has been proposed to provide such coils with internally positioned coil forms which in addition to stabilizing the coil axially serve as a support for a threaded tuning slug carried within the coil.

It is a general object of this invention to provide a thermally stable coil assembly with the above advantages but which is less expensive to fabricate.

It is another advantage to provide such a coil assembly which provides an external covering for the coil and integral means for supporting a tuning slug.

The invention is carried out by providing a coil wound of stiff wire and including integral leads, a pair of mating housing halves enveloping the coil and having internal ribs extending between the turns of the coil to prevent axial expansion of the coil, and providing passages for the leads to extend through the housing. The invention further contemplates that the internal ribs extend beyond the inner diameter of the coil to support an adjustable tuning slug concentrically with the coil.

The above and other advantages will be made more apparent from the following specification taken in conjunction with the accompanying drawings wherein like reference numerals refer to like parts and wherein.

Figure 1:
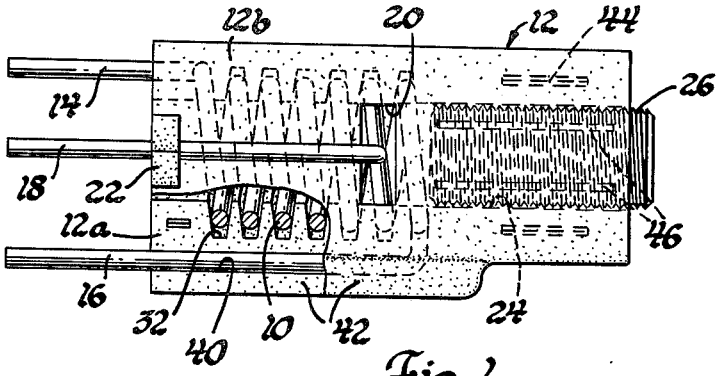
FIG. 1 is a partly broken away elevational view of a coil assembly according to the invention.
Figure 2:
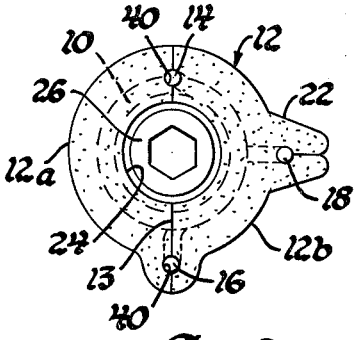
FIG. 2 is an end view of the coil assembly of FIG. 1.

As shown in FIGS. 1 and 2, a coil assembly according to the invention comprises an electrical coil 10 enclosed within an outer housing 12, coil terminal leads 14 and 16 extending from either end of the coil and projecting outside the housing in a direction parallel to the coil axis, and a terminal lead 18 which extends laterally from the coil 10 through a window 20 in the side of the housing 12 and then parallel to the leads 14 and 16. The lead 18 extends through a supporting ear 22 projecting from the side of the housing 12. A central opening 24 in the housing 12, coaxial with the coil 10, supports an externally threaded tuning slug 26 which is provided with a hex drive recess to facilitate turning the slug for axial adjustment relative to the coil 10. The housing 12 is comprised of two housing halves 12*a* and 12*b* which meet at a parting line 13.

Figure 3:
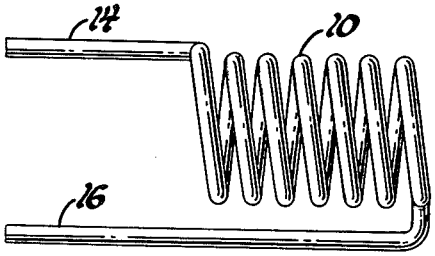
FIG. 3 is a view of the coil of FIG. 1.

FIG. 3 shows the coil 10. The coil is fabricated, for example, of 0.032 inch diameter tinned copper wire formed into 6.5 turns at 18 turns per inch. The coil turns are thus spaced and the coil and its integral leads are sufficiently rigid to maintain its own shape in the absence of stresses such as those caused by thermal changes.

Figure 4:
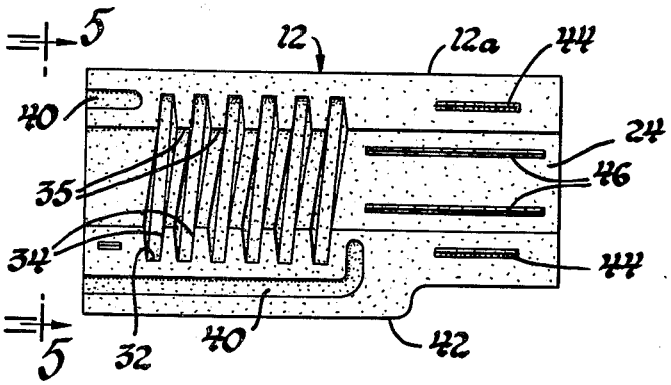
FIG. 4 is an elevational view of one half of the housing of the assembly of FIG. 1.
Figure 5:
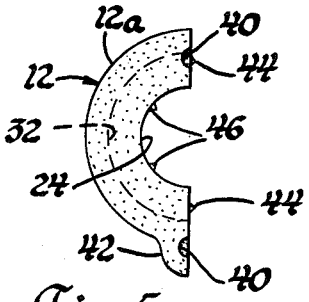
FIG. 5 is an end view of the housing part as viewed along line 5—5 of FIG. 4.

FIGS. 4 and 5 show the housing half 12*a*. The housing halves are each molded of insulating material such as ABS plastic. In the region of the housing which receives the coil 10, a series of grooves 32 and ridges 34 are provided in the internal wall of the housing in a form to match the pitch of the coil turns. The ribs 34 extend radially inward far enough to extend between the coil turns and beyond the inner diameter of the coil 10 with the inner faces 35 of the ribs terminating at the surface of an imaginary cylinder coaxial with the coil. In cross section, the groove bottoms and the rib walls and faces are straight line segments. Each housing half contains depressions 40 parallel to the coil axis to accomodate the leads 14 and 16. Each housing half is generally hemispherical except for a lateral bulge 42 at one side thereof to allow room for enclosing the lead 16.

Each rib is tapered with its narrowest portion directed inwardly toward the axis. This feature allows a relatively large entrance way in each groove to facilitate the insertion of the preformed coil 10 into the molded grooves. The grooves are sufficiently deep and narrow that the coil is spaced from the groove bottoms but engages the groove sides. Upon assembly, the coil is inserted into one housing half and the other housing half is tightly pressed into mating position with the first half and the two are secured together by ultrasonic welding. Very small triangular beads 44 on one of the housing halves facilitates the ultrasonic welding process, i.e. during the initial part of the welding process the ultrasonic energy is concentrated at the beads and the weld area is concentrated around the beads. The parts are so dimensioned that during the assembly of the housing halves, the coil turns will have a tendency to embed themselves into the sides of the grooves thereby very tightly securing the coil inside the housing. In particular, axial expansion of the coil is restrained. The coil is completely captivated and the assembly is rigid.

The lead 18, if such is desired, is then inserted through the aperture 20 and butt welded to the coil 10. The leg of the lead 18 is ultrasonically welded with the ear 22, the ear 22 being bifurcated originally to receive the lead 18 before the welding step. The tuning slug 26 is made of powdered iron, for example, and is externally threaded. Elongated ridges 46 of triangular cross section are formed in both housing halves on the inner surface of the opening 24 to engage the threads on the slug so that when the slug is axially driven into the coil and adjusted to a desired location by turning the slug internal mating threads are formed in the ridges 46. When the slug enters the coil, per se, the ribs 34 form the support for the slug so that the slug forms threads on the inner faces 35 of the ribs as it advances into the coil. The ribs 34 then concentrically space the slug at a fixed radial distance from the coil.

Figure 6:
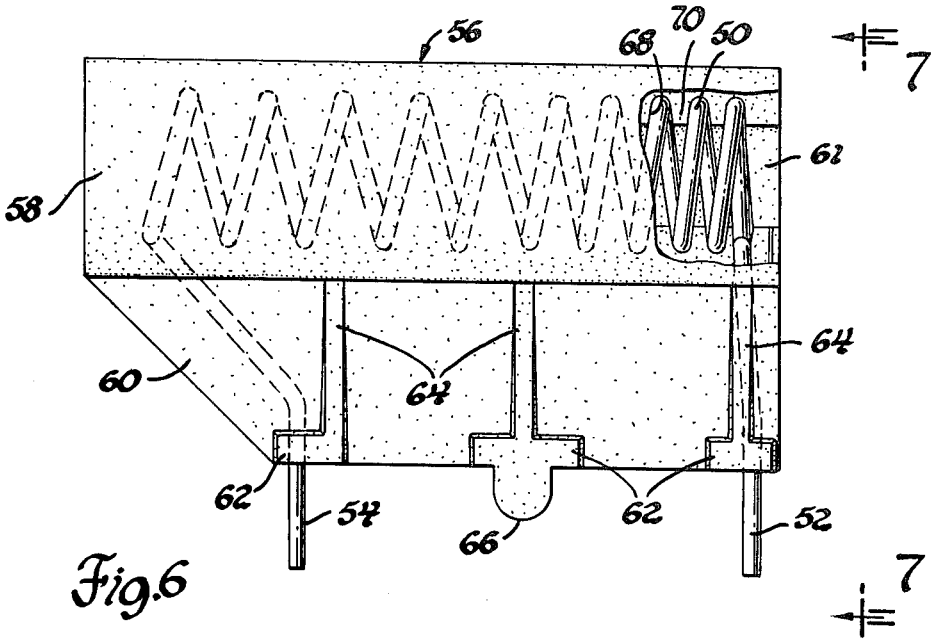
FIG. 6 is an elevational view of a coil assembly according to a second embodiment of the invention.
Figure 7:
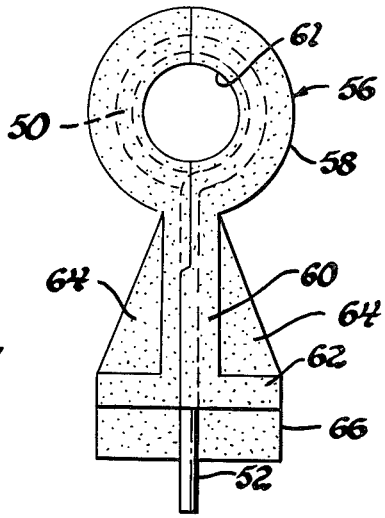
FIG. 7 is an end view of the coil assembly as viewed along line 7—7 of FIG. 6.

FIGS. 6 and 7 illustrate a second embodiment of the invention as applied to a nonlinear coil for use in an FM oscillator. The coil 50 is helical but has a variable pitch which is small at one end and gradually becomes larger toward the other end. The lead 52 from one end extends generally radially outward from the coil 50 while the lead 54 from the other end extends laterally outwardly on a diagonal path and then is bent to finally extend radially outwardly. Thus the coil is designed for attachment to a printed circuit board with the coil axis parallel to the board. A two-part housing 56 surrounding the coil has a generally cylindrical portion 58 concentric with the coil 50 and a laterally extending web portion 60 enclosing a portion of the leads 52, 54. A cylindrical opening 61 extends through the cylindrical portion 58 concentric with the coil axis. Three spaced feet portions 62 are attached to the web 60 and are supported by diagonal braces 64. The feet portions 62 thus provide a base for engaging a printed circuit board. The leads 52 and 54 extend well beyond the feet portions 62. A key member 66 depends from the central foot portion 62 to engage a locating hole within a printed circuit board.

Figure 8:
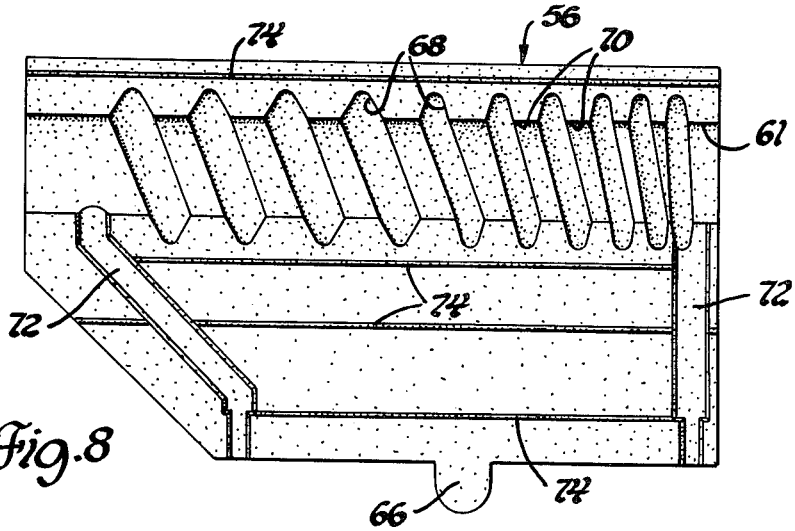
FIG. 8 is an elevational view of the housing half of the coil assembly of FIG. 6.

FIG. 8 shows one of the housing halves 56 in which grooves 68 are formed in the inner surface of the housing 56 to accomodate the coil turns, the grooves defining intervening ribs 70 which extend between the coil turns. In order to accomodate the changing pitch of the coil 50, the grooves corresponding to the coil turns of small pitch has a small taper angle of the groove walls while the corresponding taper is larger for those turns of large pitch. The bottom of the grooves are rounded at the same radius as the wire of the coil 50 so that the coil rests snugly in the bottom of the grooves. Passages or depressions 72 formed in the web and feet portions of the housing receive the leads 52 and 54. Weld beads 74 are formed in elongated paths along the housing half to facilitate ultrasonic welding. As is the case with the coil assembly previously described, the coil is inserted into the one housing half and the other half is mated to and pressed on to the first half and the two halves are ultrasonically welded together to captivate the coil.

It will thus be seen that the coil assembly according to this invention provides an outer housing furnishing dimensional stability for electrical coils and includes internal ribs extending between coil turns to securely locate the turns in predetermined position thereby affording that stability and especially protecting the coil against axial dimensional changes due to thermal stresses. The housing further protects the coil and insulates the main body of the coil and provides firm support for terminal leads which may extend axially or laterally from the coil body. The housing portions are easily fabricated by injection molding and whereas for either embodiment of the invention a single mold cavity is used to define the outer housing configuration, the housing is readily adapted for use with coils of different design, e.g. different pitches and numbers of turns, merely by substituting different mold inserts thereby providing economic tooling for a variety of coil designs.

The embodiments of the invention in which an exclusive property or privilege is claimed are defined as follows:

1. A dimensionally stable encapsulated electrical coil assembly comprising; an electrical coil having spaced coil turns formed of wire sufficiently stiff to render the coil initially self supporting but requiring further support for predetermined dimensional stability, the coil terminating in integral terminal leads extending away from the coil, a pair of insulating mating housing portions defining a parting line in a plane substantially on the axis of the coil secured together to enclose the coil, each housing portion having a plurality of integral ribs extending inwardly between the spaced coil turns and contacting the coil turns to securely contain the coil turns, the ribs being spaced about the axis of the coil to resist movement of the coil in the direction of the axis thereof, passages defined in at least one of the housing portions, and the said terminal leads extending through the passages, thereby providing a stable coil assembly surrounded by an insulating housing and having terminal leads extending therefrom.

2. A dimensionally stable encapsulated electrical coil assembly comprising; an electrical coil having spaced coil turns formed of wire sufficiently stiff to render the coil initially self supporting but requiring further support for predetermined dimensional stability, the coil terminating in integral terminal leads extending away from the coil, a pair of insulating mating housing portions defining a parting line in a plane substantially on the axis of the coil secured together to enclose the coil, each housing portion having a plurality of integral ribs extending inwardly between the spaced coil turns, the ribs having tapered walls to define tapered grooves between the ribs to receive the coil turns, the tapered walls being tightly wedged against the respective coil turns to securely contain the coil turns, the ribs being spaced about the axis of the coil to resist movement of the coil in the direction of the axis thereof, passages defined in at least one of the housing portions, and the said terminal leads extending through the passages, thereby providing a stable coil assembly surrounded by an insulating housing and having terminal leads extending therefrom.

3. A dimensionally stable encapsulated electrical coil assembly comprising; an electrical coil having spaced coil turns formed of wire sufficiently stiff to render the coil initially self supporting but requiring further support for predetermined dimensional stability, the coil terminating in integral terminal leads extending away from the coil, a pair of insulating mating housing portions defining a parting line in a plane substantially on the axis of the coil secured together to enclose the coil and defining an aperture coaxial with the coil extending through the assembly, each housing portion having a plurality of integral ribs extending radially inwardly between the spaced coil turns and terminating at inner faces on a cylindrical surface concentric with the coil and spaced inwardly of the coil turns, the ribs having side walls contacting the coil turns to securely contain the coil turns, the ribs being spaced about the axis of the coil to resist movement of the coil in the direction of the axis thereof, passages defined in at least one of the housing portions, and the said terminal leads extending through the passages, thereby providing a stable coil assembly surrounded by an insulating housing and having terminal leads extending therefrom.

4. A dimensionally stable encapsulated electrical coil assembly comprising; an electrical coil having spaced coil turns formed of wire sufficiently stiff to render the coil initially self supporting but requiring further support for predetermined dimensional stability, the coil terminating in integral terminal leads extending away from the coil, a pair of insulating mating housing portions defining a parting line in a plane substantially on the axis of the coil secured together to enclose the coil and defining an aperture coaxial with the coil extending through the assembly, each housing portion having a plurality of integral ribs extending radially inwardly between the spaced coil turns and terminating at inner faces on a cylindrical surface concentric with the coil and spaced inwardly of the coil turns, the ribs having side walls contacting the coil turns to securely contain the coil turns, the ribs being spaced about the axis of the coil to resist movement of the coil in the direction of the axis thereof, a conductive tuning slug adjustably secured within the coil and supported by the rib faces concentric with the coil, passages defined in at least one of the housing portions, and the said terminal leads extending through the passages, thereby providing a stable coil assembly surrounded by an insulating housing and having terminal leads extending therefrom.

5. A dimensionally stable encapsulated electrical coil assembly comprising; an electrical coil having spaced coil turns formed of wire sufficiently stiff to render the coil initially self supporting but requiring further support for predetermined dimensional stability, the coil terminating in integral terminal leads extending away from the coil, a pair of insulating mating housing portions defining a parting line in a plane substantially on the axis of the coil secured together to enclose the coil and defining an aperture coaxial with the coil extending through the assembly, each housing portion having a plurality of integral ribs extending radially inwardly between the spaced coil turns and terminating at inner faces on a cylindrical surface concentric with the coil and spaced inwardly of the coil turns, the ribs having side walls contacting the coil turns to securely contain the coil turns, the ribs being spaced about the axis of the coil to resist movement of the coil in the direction of the axis thereof, an externally threaded conductive tuning slug threadedly secured to the inner faces of the ribs for axial adjustment by turning, the slug thereby being spaced from the coil and coaxial therewith, passages defined in at least one of the housing portions, and the said terminal leads extending through the passages, thereby providing a stable coil assembly surrounded by an insulating housing and having terminal leads extending therefrom.

6. A dimensionally stable encapsulated electrical coil assembly comprising; an electrical coil having spaced coil turns formed of wire sufficiently stiff to render the coil initially self supporting but requiring further support for predetermined dimensional stability, the coil terminating in first and second integral terminal leads extending away from the coil, a pair of insulating mating housing portions defining a parting line in a plane substantially on the axis of the coil secured together to enclose the coil, each housing portion having a plurality of integral ribs extending inwardly between the spaced coil turns and contacting the coil turns to securely contain the coil turns, the ribs being spaced about the axis of the coil to resist movement of the coil in the direction of the axis thereof, passages defined in at least one of the housing portions, and the said terminal leads extending through the passages, an aperture in one of the housing portions adjacent a coil turn, and a third terminal lead connected to the said adjacent coil turn and extending through the said aperture, thereby providing a stable coil assembly surrounded by an insulating housing and having terminal leads extending therefrom.

* * * * *